US010072643B2

(12) United States Patent
Williams et al.

(10) Patent No.: US 10,072,643 B2
(45) Date of Patent: Sep. 11, 2018

(54) STEAM OPERATED, SELF CYCLING, DIAPHRAGM WATER PUMP

(71) Applicants: Jennifer Williams, North Hollywood, CA (US); Craig Duda, North Hollywood, CA (US)

(72) Inventors: Jennifer Williams, North Hollywood, CA (US); Craig Duda, North Hollywood, CA (US)

( * ) Notice: Subject to any disclaimer, the term of this patent is extended or adjusted under 35 U.S.C. 154(b) by 223 days.

(21) Appl. No.: 15/135,058

(22) Filed: Apr. 21, 2016

(65) Prior Publication Data

US 2016/0298615 A1 Oct. 13, 2016

Related U.S. Application Data

(63) Continuation-in-part of application No. 14/577,215, filed on Dec. 19, 2014, now Pat. No. 9,516,986.

(51) Int. Cl.

| | |
|---|---|
| ***F04F 1/18*** | (2006.01) |
| ***F04B 1/18*** | (2006.01) |
| ***F04B 9/127*** | (2006.01) |
| ***F04B 45/053*** | (2006.01) |
| ***F04B 43/02*** | (2006.01) |
| ***F04B 45/04*** | (2006.01) |

(Continued)

(52) U.S. Cl.

CPC ..... *F04B 9/127* (2013.01); *F04B 19/24* (2013.01); *F04B 43/02* (2013.01); *F04B 43/028* (2013.01); *F04B 45/045* (2013.01); *F04B 45/0533* (2013.01); *F04B 45/0536* (2013.01); *F04B 49/03* (2013.01); *F04F 1/18* (2013.01)

(58) Field of Classification Search

CPC ..... F04F 1/00; F04F 1/16; F04F 1/18; F04B 7/02; F04B 9/08; F04B 9/10; F04B 9/107; F04B 9/1076; F04B 9/12; F04B 9/123; F04B 9/127; F04B 19/24; F04B 45/04; F04B 45/053; F04B 45/0536; F04B 45/045; F04B 49/02; F04B 49/06; F04B 43/02; F04B 43/06; F04B 43/067; F04B 43/073; F04B 43/0733; F04B 43/028

USPC ..... 417/379

See application file for complete search history.

(56) References Cited

U.S. PATENT DOCUMENTS 2,220,209 A 11/1940 Carpenter
2,389,067 A * 11/1945 Lieberman ..... F04B 9/12 417/379

(Continued)

FOREIGN PATENT DOCUMENTS

DE 4239464 5/1994

*Primary Examiner* — Nathan Zollinger

(57) ABSTRACT

A diaphragm pump mechanism is powered by steam generated by an internal heater coil heating the pumped water, which moves the diaphragm and an attached piston to pump water through the pump. The heater coil is turned on-and-off using a switch that is timed to the movement of the pump. The water is pumped through a series of one-way rubber valves and reed valves to prevent a back flow of water. The pressure generated by the steam is released when a reed valve located on the diaphragm makes contact with a pin located on the body of the pump, opening the reed valve and allowing the steam to travel through and to condense. The piston and diaphragm are returned to the starting position when the steam pressure is released by a spring attached to the pump shaft. On the return stroke an accumulator refills the diaphragm chamber with water.

8 Claims, 2 Drawing Sheets

(51) Int. Cl.
*F04B 19/24* (2006.01)
*F04B 49/03* (2006.01)

(56) References Cited

U.S. PATENT DOCUMENTS 2,851,957 A 9/1958 Ragland
2,183,421 A 12/1959 Brady
3,285,001 A * 11/1966 Turnblade ..... F04F 1/16
417/130
4,177,019 A * 12/1979 Chadwick ..... F03G 6/06
417/379
4,207,034 A * 6/1980 Zeimer ..... F04B 43/06
417/379
4,451,210 A * 5/1984 Shaubach ..... F04B 19/24
417/209
4,508,493 A * 4/1985 O'Hare ..... F04F 1/04
417/379
5,114,318 A * 5/1992 Freeborn ..... F03G 6/00
417/379
5,220,943 A * 6/1993 Zink ..... B67D 7/02
137/347
5,865,086 A * 2/1999 Petichakis ..... B63H 11/02
60/325
6,290,469 B1 9/2001 Archhibald
6,948,918 B2 * 9/2005 Hansen ..... A61M 5/14224
417/395
7,021,900 B2 * 4/2006 Prueitt ..... F04F 1/04
417/137
7,866,953 B2 * 1/2011 Johnston ..... F04B 43/073
417/228
8,353,684 B2 * 1/2013 Peacock ..... F04B 19/24
417/244
8,454,325 B2 * 6/2013 Fisher ..... F04B 47/08
417/401

* cited by examiner

STEAM OPERATED, SELF CYCLING, DIAPHRAGM WATER PUMP

CROSS-REFERENCE TO RELATED APPLICATIONS

This application claims the priorities pursuant to 35 USC 120 and is a continuation in part of application entitled, "Flash Steam Generator", Ser. No. 14/577,215 filed on Dec. 19, 2014, which in turn was a continuation in part of US patent application entitled, "Optimally Compact Ergonomic Hand-Held Combination Flash Heated Steam Cleaning Generator/Wet and Dry Vacuum Cleaner And Container Design, filed on Mar. 18, 2013, Ser. No. 13/736,040, the contents of which applications are incorporated herein by reference in their entirety.

BACKGROUND

1. Field of the Invention

The present invention relates to diaphragm pumps. More specifically, the invention relates to a diaphragm pump that heats the water being pumped into steam to power both a diaphragm and a piston. The novel invention is therefore quiet when it is operated and pumping water, compared to most contemporary diaphragm pumps, which utilize an electric motor to power the diaphragm. The most relevant CPC classes are, F04D13, pumping installations or systems; F04B43, machines, pumps, or pumping installations having flexible working members; and FO4B19/24, pumping by heat expansion of pumped fluid.

2. Description of the Prior Art

Many household devices, such as a steam generator, require a supply of water to be supplied to the appliance in order to operate. Many of these appliances utilize a pump that is driven by an electric motor. These pumps are often large, noisy, and require maintenance. A pump capable of being compact, quiet, with few moving parts that require maintenance would be very useful for most consumers.

Using a piston and piston rod to pump fluids is well known in the art of water pumps. Prior art describes a diaphragm pump that also includes a spring to power the diaphragm on the return stroke in addition to the diaphragm. Prior art has also described attaching a piston system to a diaphragm to power the diaphragm pump and the use of one-way valves to create a flow of liquid.

Prior art describes using water to power a diaphragm pump by heating it to steam using a heater element outside of the pump, and using a spring to help power the return stroke of the diaphragm. The diaphragm also acts as its own pressure release valve by opening at the top of the diaphragm's movement due to a deformation in the center spindle. Prior art also describes using a heating element in direct contact with water to heat it to a boil to pump water using the steam bubble to move the water past the heating element.

Prior art also describes a portable, self-contained pump having a battery carried on board and demonstrates a pump connected to a battery or electrical system None of the preceding inventions and patents alone or in a combination describe the present invention.

BRIEF SUMMARY

The present invention is a steam powered diaphragm pump for pumping water. The preferred embodiment of the water pump includes a pump shaft that reciprocates in the pump cylinder. Water is pumped from an inlet downstream inside the pump cylinder to an outlet. The downstream end of the pump cylinder communicates with a cylindrical diaphragm pump chamber. The downstream end of the pump shaft is connected to a hub of a corrugated flexible metal wave diaphragm in the diaphragm chamber. A radially and/or spirally wound cable heater coil is disposed in the diaphragm chamber between the diaphragm and the piston cylinder. Electrical current is supplied to the heater coil through a magnetically operated electrical switch located adjacent to the upstream end of the piston shaft. A magnet is attached to the upstream end of the piston shaft, and opposing magnets on the end of the magnetically operated electrical switch are moved by the magnet on the piston shaft to operate the magnetically operated electrical switch and switch the electrical current on-and-off to the heater coil. When the piston rod is positioned at its upstream starting position, the switch is turned on and electrical current is supplied to the cable heater coil in the diaphragm chamber, to the transformer and the water deionizing coil. At this point the piston is at the beginning of its power stroke.

A piston shaft bearing mount hub is secured to the inside of the piston cylinder and guides the piston shaft as it reciprocates in the piston cylinder. On the downstream side of the hub is a rubber cone through which the piston shaft extends that selectively allows water to flow through the cone around the piston shaft and acts as a seal when water pressure is applied to the cone in the opposite upstream direction. Downstream from the cone on the piston rod is the piston with a double cone shaped outside diameter seal. The piston forces water downstream when the piston shaft moves in the downstream direction, and then allows water to flow past the outside diameter of the piston when the piston is moved in the upstream direction. Downstream from the piston is a conical return compression spring through which the piston shaft extends, and a downstream piston shaft bearing mount hub with a conical seal. The piston shaft thus reciprocates within the cylinder pump cylinder as it is securely axially retained by the two piston shaft bearing mount hubs. When the piston moves downstream, it draws or sucks water through the upstream hub and forces or pushes it through the downstream hub. Downstream from the downstream hub is an external resilient accumulator bladder which is a rubber sheet that stretches and fills with water which is pushed into it by the piston. Downstream from the piston cylinder, the piston shaft enters the upstream portion of the diaphragm chamber where the water is turned into steam by the heater coil. The steam pressure forces an upper diaphragm chamber reed valve closed through which reed valve the piston shaft extends, which prevents water in the upstream portion of the diaphragm chamber from back-flowing into the piston cylinder.

There is also a normally open reed valve on the upstream side of the diaphragm hub that covers a through hole defined through the diaphragm hub, which allows the expanding steam and water to force the diaphragm and the connected downstream end of the piston shaft downstream against the restraining force of the conical compression spring and accumulator bladder. When the diaphragm reaches or nears the downstream wall of the diaphragm chamber a pin mounted in the downstream wall projects up through the through hole in the diaphragm. The pin opens the now closed reed valve in the diaphragm hub, which is a normally opened valve. Before the reed valve on the diaphragm hub engages the pin, the water in the downstream side of the diaphragm chamber is forced through a hole in the chamber wall that in turn has an outlet reed valve outside of the wall. The water is then injected from the outlet of the diaphragm chamber under pressure into tubing communicated with the steam generating flash boiler chamber. When the diaphragm reed valve is opened by the pin, the water pressure on both sides of the diaphragm chamber is equalized. This allows the water that is stored under pressure in the accumulator chamber to flow past the upper diaphragm chamber reed valve and also through the normally open reed valve in the diaphragm hub, now being held open against pressure by the pin, into the downstream portion of the diaphragm chamber communicating directly with the outlet.

The outlet reed valve is held closed by the water pressure outside of the pump downstream of the outlet if that pressure is higher. The piston and piston shaft are forced upstream to the cycle starting position by the conical spring between the piston and the downstream hub. When the piston shaft nears its ending position, the magnet on the upstream end of the piston shaft trips the magnetically operated electrical switch, cutting off current to the diaphragm cable heater coil, the transformer and the water deionizing coil. The switch remains off until the piston shaft reaches the starting position and magnetically trips the switch back on to supply current again to the cable heater coil, transformer and water deionization coil, thus starting the steaming and pumping cycle over again.

The illustrated embodiment of the invention can now be understood to include a pump for pumping water with a pump cylinder having an inlet for receiving water, a pump shaft that moves between a starting and ending position, a piston mounted on the pump shaft to move water in a predetermined direction through the pump cylinder, and a spring disposed around the pump shaft to return the piston to the starting position. The pump cylinder is attached to a diaphragm chamber containing a heater coil, a movable diaphragm that divides the diaphragm chamber into two portions that is also attached to the pump shaft, and valving that prevents the back flow of water into the pump cylinder. The heater coil heats the water in the first portion of the diaphragm chamber into steam, which provides pressure to the seals and forces the diaphragm towards the water outlet in the pump body and moving it to its ending position. Once the diaphragm moves to its final position, it comes in contact with a valve release that engages and opens the diaphragm valving, allowing steam to flow past the diaphragm and equalize the pressure on both sides of the diaphragm, which allows the spring to return the piston, pump shaft and diaphragm to its original positions. The heater coil is controlled by a switch that selectively provides electrical power to the heater coil when the pump shaft is moving from its starting position toward its ending position.

The pump also has pump cylinder valving in the pump cylinder to allow water to move only in the predetermined direction in the pump cylinder. The switch that controls the heater coil is a mechanical switch that is toggled by a magnet that is attached to the pump shaft itself, or it alternatively may be controlled by a digital switch and a digital control circuit. The pump also uses a rubber bladder to temporarily store water to be supplied to the heater coil for generation of steam as the pump shaft returns to its starting position. The pump is also attached to a water filter and a water deionization device. The valving in the diaphragm is a reed valve.

The illustrated embodiments of the invention include a method where water is heated with a heater coil, causing it to turn into steam and expand to move a diaphragm, then it turns off the heater coil using a switch, and uses the moving diaphragm to move a piston, which pumps water and compresses a spring, which eventually expands to return the piston and diaphragm to a starting position, and then refills the area around the heater coil and the diaphragm chamber with water and turns the heater coil back on to restart the entire pumping cycle.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Description

Figure 1:
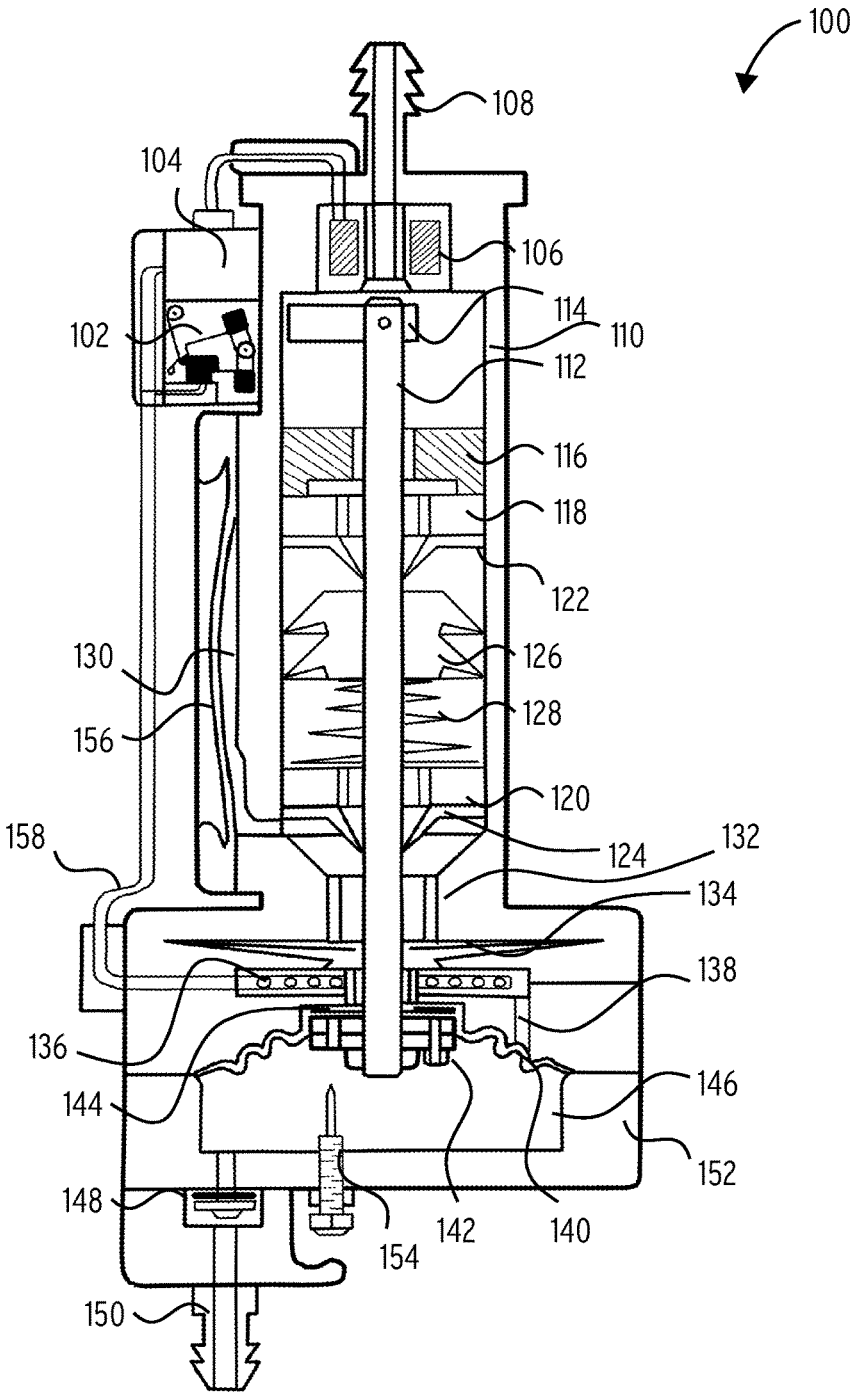
FIG. 1 is a cross-sectional view of the preferred embodiment of the steam operated, self-cycling, diaphragm water pump in its starting position.

In FIG. 1, a cross-sectional view of the preferred embodiment of the steam operated, self-cycling, diaphragm water pump is illustrated. The water pump is comprised of two sections, the pump shaft assembly in piston cylinder 110 and the diaphragm pump assembly in the diaphragm pump chamber 152.

The operating cycle is described as follows. Starting from the bottom to top of FIG. 1, the water pump steam powered circular rippled wave diaphragm 140 is powered by the steam generating heater coil 136 through the electrical current controlled by the on-and-off switch 102, which is controlled by remote switch activating magnet 114 on the pump shaft 112. Mounted above on-and-off switch 102 is a voltage transformer 104 that energizes a water deionizing coil 106, located immediately downstream from water inlet 108 of piston cylinder 110. The up and down movement of remote switch activating magnet 114 cycles AC electricity through on-and-off switch 102 to transformer 104 and water deionizing coil 106 through magnetic repulsion of the two rocker switch magnets in on-and-off switch 102 by the remote switch activating magnet 114 on pump shaft 112 and cycles current to steam generating heater coil 136. At the bottom end of the power stroke, remote switch activating magnet 114 opens on-and-off switch 102 breaking the electrical current flow through components 102, 104, 106, and 136.

Starting at the top of the pump by water inlet 108, the pump shaft 112 goes through the water filter 116, and the first of two pump shaft bearing supports 118 and 120. The water flows through the holes of pump shaft bearing support 118, going through piston cylinder 110 to the pump shaft piston 126. On the lower side of the bearing supports 118 and 120, are mounted rubber combination one-way cone valves, namely one way rubber valve 122 and one way rubber valve 124. These valves prevent back-flow of water (upstream) by hydraulic compression against the outside diameter of the pump shaft 112. The valve section of one way rubber valve 122 also allows water to flow through piston cylinder 110 by the expansion of the one way rubber valve 122 that snugly grips the pump shaft 112, allowing the water to be forced by the pump shaft 112. On the down stroke the water is pulled by suction through the top valve 122, and pushed through the lower valve 124, by the pump shaft piston 126. On the up, return stroke, the pump shaft piston 126 lips compress as a valve, to allow water to be forced past the piston 126, as the top cone 122 seals itself against the pump shaft 112, and so this transfers the water from hubs 118 to 120, as the pump shaft piston 126 rises on its return stroke. On the power stroke down, the piston lips are forced out against the inside diameter of the piston cylinder 110, making a water tight hydraulic seal. Also, in the down power stroke the pump shaft piston 126 forces the water into the water accumulator chamber 130. On the down power stroke, the water cannot pass through into diaphragm pump chamber 152 after passing through water pathway 132 because the reed valve 134 is closed by the steam pressure in the steam chamber in diaphragm pump chamber 152. Therefore, the water is forced into the water accumulator chamber 130, and is stored there under the ambient atmospheric pressure on the outside of the rubber accumulator bladder 156. The water is stored there until the completion of the downward power stroke of the pump shaft piston 126 and the steam powered circular rippled wave diaphragm 140, at which time the water is forced from the water accumulator chamber 130 by ambient outside air pressure, and the elastomer spring effect of the rubber accumulator bladder 156 forces the open reed valve 134 on the return stroke up, recharging the system with water.

In the beginning of the power stroke, the steam powered circular rippled wave diaphragm 140, is forced downward by the steam generating heater coil 136, heating the water as it traverses around the spiral shaped heater coil 136 and turning it to steam. On the downstream side of the steam powered circular rippled wave diaphragm 140, is the water reservoir and steam condensing chamber 146. On the power stroke downward, the steam pressure forces the reed valve 134 closed against the water pressure in piston cylinder 110, the steam leaves generating heater coil 136 through steam passage hole 138 and holds closed the normally open reed valve 144 located in the diaphragm hub 142 of the power diaphragm 140, allowing the expanding steam to force the diaphragm 140 down, thereby forcing the water in the water reservoir and steam condensing chamber 146, through the reed valve 148 on the body of diaphragm pump chamber 152, and out of water outlet 150 at 100 PSI or higher pressure. On the return stroke, normally open reed valve 144, allows the steam from the steam chamber and the water to flow through the diaphragm hub 125 and recharge the water reservoir and steam condensing chamber 146, which also acts as a steam condenser when the water is later injected into it. There is a sufficient amount of injected water to condense the steam in the water reservoir and steam condensing chamber 146. On the return stroke, the reed valves 134 and 144 are open as the water flows from the accumulator 130, refilling the area around the steam generating heater coil 136, and the water reservoir and steam condensing chamber 146. This return stroke is activated when the hub 142 reaches the bottom of the power stroke, where a hole in the hub 142 allows the reed valve 144 to run into the adjustable ejector pin in the wall of the pump body 152. At this time the magnet 114 switches off the electric current to the heater coil 136, and transformer 104 coupled to the water deionizing coil 106. When the reed valve 144 hits pin 154, it opens the reed valve 144, thereby releasing all pressure in 152, as water flows under pressure from the accumulator through the reed valve 134 and 144. Pump shaft and diaphragm pump return spring 128, located on the pump shaft in piston cylinder 110, pushes the piston rod up to the starting position. At this point the magnet 114 switches the electrical current back on and the water pump cycle is restarted.

Figure 2:
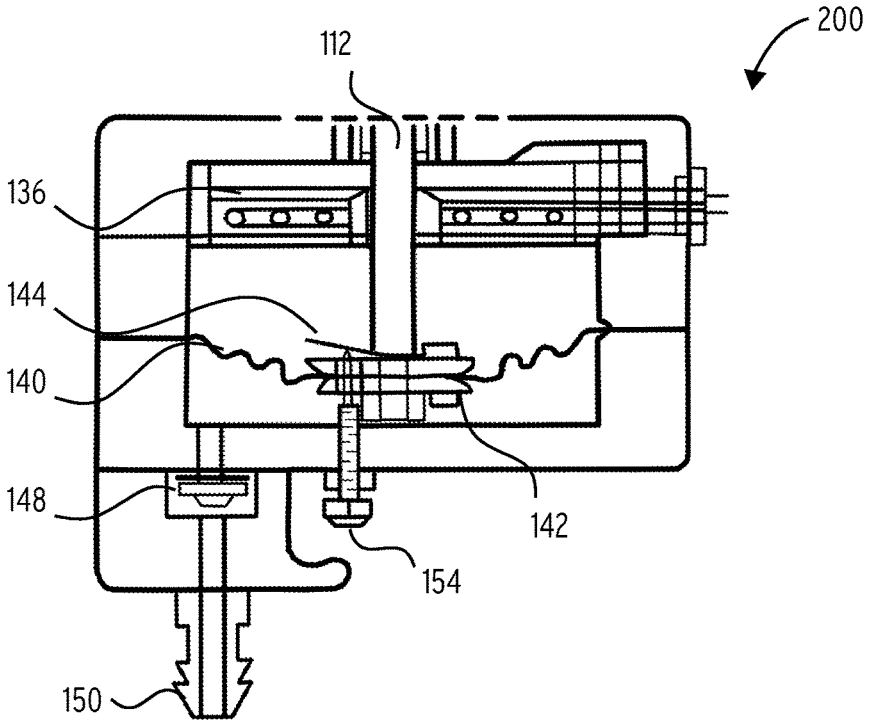
FIG. 2 is a cross-sectional view of the lower portion of the water pump showing the position of the circular rippled wave diaphragm when it is fully expanded by steam. The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

Referring to FIG. 2, the cross-sectional diagram demonstrates how steam powered circular rippled wave diaphragm 140 is expanded when steam generating heater coil 136 creates steam to push down on the diaphragm. Diaphragm 140 is pushed down onto stroke stopping, adjustable reed valve opening pin 154, causing reed valve 144 to open and let water and steam through hub 142.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

Drawings

In FIG. 1, a cross-sectional view of the preferred embodiment of the steam operated, self-cycling, diaphragm water pump is illustrated. The water pump is comprised of two sections, the pump shaft assembly in piston cylinder 110 and the diaphragm pump assembly in the diaphragm pump chamber 152.

The operating cycle is described as follows. Starting from the bottom to top of FIG. 1, the water pump steam powered circular rippled wave diaphragm 140 is powered by the steam generating heater coil 136 through the electrical current controlled by the on-and-off switch 102, which is controlled by remote switch activating magnet 114 on the pump shaft 112. Mounted above on-and-off switch 102 is a voltage transformer 104 that energizes a water deionizing coil 106, located immediately downstream from water inlet 108 of piston cylinder 110. The up and down movement of remote switch activating magnet 114 cycles AC electricity through on-and-off switch 102 to transformer 104 and water deionizing coil 106 through magnetic repulsion of the two rocker switch magnets in on-and-off switch 102 by the remote switch activating magnet 114 on pump shaft 112 and cycles current to steam generating heater coil 136. At the bottom end of the power stroke, remote switch activating magnet 114 opens on-and-off switch 102 breaking the electrical current flow through components 102, 104, 106, and 136.

Starting at the top of the pump by water inlet 108, the pump shaft 112 goes through the water filter 116, and the first of two pump shaft bearing supports 118 and 120. The water flows through the holes of pump shaft bearing support 118, going through piston cylinder 110 to the pump shaft piston 126. On the lower side of the bearing supports 118 and 120, are mounted rubber combination one-way cone valves, namely one way rubber valve 122 and one way rubber valve 124. These valves prevent back-flow of water (upstream) by hydraulic compression against the outside diameter of the pump shaft 112. The valve section of one way rubber valve 122 also allows water to flow through piston cylinder 110 by the expansion of the one way rubber valve 122 that snugly grips the pump shaft 112, allowing the water to be forced by the pump shaft 112. On the down stroke the water is pulled by suction through the top valve 122, and pushed through the lower valve 124, by the pump shaft piston 126. On the up, return stroke, the pump shaft piston 126 lips compress as a valve, to allow water to be forced past the piston 126, as the top cone 122 seals itself against the pump shaft 112, and so this transfers the water from hubs 118 to 120, as the pump shaft piston 126 rises on its return stroke. On the power stroke down, the piston lips are forced out against the inside diameter of the piston cylinder 110, making a water tight hydraulic seal. Also, in the down power stroke the pump shaft piston 126 forces the water into the water accumulator chamber 130. On the down power stroke, the water cannot pass through into diaphragm pump chamber 152 after passing through water pathway 132 because the reed valve 134 is closed by the steam pressure in the steam chamber in diaphragm pump chamber 152. Therefore, the water is forced into the water accumulator chamber 130, and is stored there under the ambient atmospheric pressure on the outside of the rubber accumulator bladder 156. The water is stored there until the completion of the downward power stroke of the pump shaft piston 126 and the steam powered circular rippled wave diaphragm 140, at which time the water is forced from the water accumulator chamber 130 by ambient outside air pressure, and the elastomer spring effect of the rubber accumulator bladder 156 forces the open reed valve 134 on the return stroke up, recharging the system with water.

In the beginning of the power stroke, the steam powered circular rippled wave diaphragm 140, is forced downward by the steam generating heater coil 136, heating the water as it traverses around the spiral shaped heater coil 136 and turning it to steam. On the downstream side of the steam powered circular rippled wave diaphragm 140, is the water reservoir and steam condensing chamber 146. On the power stroke downward, the steam pressure forces the reed valve 134 closed against the water pressure in piston cylinder 110, the steam leaves generating heater coil 136 through steam passage hole 138 and holds closed the normally open reed valve 144 located in the diaphragm hub 142 of the power diaphragm 140, allowing the expanding steam to force the diaphragm 140 down, thereby forcing the water in the water reservoir and steam condensing chamber 146, through the reed valve 148 on the body of diaphragm pump chamber 152, and out of water outlet 150 at 100 PSI or higher pressure. On the return stroke, normally open reed valve 144, allows the steam from the steam chamber and the water to flow through the diaphragm hub 125 and recharge the water reservoir and steam condensing chamber 146, which also acts as a steam condenser when the water is later injected into it. There is a sufficient amount of injected water to condense the steam in the water reservoir and steam condensing chamber 146. On the return stroke, the reed valves 134 and 144 are open as the water flows from the accumulator 130, refilling the area around the steam generating heater coil 136, and the water reservoir and steam condensing chamber 146. This return stroke is activated when the hub 142 reaches the bottom of the power stroke, where a hole in the hub 142 allows the reed valve 144 to run into the adjustable ejector pin in the wall of the pump body 152. At this time the magnet 114 switches off the electric current to the heater coil 136, and transformer 104 coupled to the water deionizing coil 106. When the reed valve 144 hits pin 154, it opens the reed valve 144, thereby releasing all pressure in 152, as water flows under pressure from the accumulator through the reed valve 134 and 144. Pump shaft and diaphragm pump return spring 128, located on the pump shaft in piston cylinder 110, pushes the piston rod up to the starting position. At this point the magnet 114 switches the electrical current back on and the water pump cycle is restarted.

Referring to FIG. 2, the cross-sectional diagram demonstrates how steam powered circular rippled wave diaphragm 140 is expanded when steam generating heater coil 136 creates steam to push down on the diaphragm. Diaphragm 140 is pushed down onto stroke stopping, adjustable reed valve opening pin 154, causing reed valve 144 to open and let water and steam through hub 142.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

What is claimed is:

1. A pump for pumping water comprising:

a pump cylinder having an inlet defined therein;

a pump shaft disposed and reciprocating in the pump cylinder between a starting and ending position;

a piston mounted on the pump shaft to move water in a predetermined direction through the pump cylinder;

a spring disposed around the pump shaft tending to return the piston to the starting position;

a diaphragm chamber communicated with the pump cylinder;

a heater coil disposed in the diaphragm chamber;

a movable diaphragm disposed in the diaphragm chamber to divide the diaphragm chamber into a first and second portion, the pump shaft extending into the diaphragm chamber and fixed to the diaphragm;

diaphragm valving in the diaphragm chamber to prevent back flow of water into the pump cylinder, the heater coil heating at least part of the water in the first portion of the diaphragm chamber into steam, the diaphragm valving preventing steam generated by the heater coil from flowing past the diaphragm so that the diaphragm is moved by steam from a first position in the diaphragm chamber to a second position in the diaphragm chamber thereby forcing water out of the lower portion of the diaphragm chamber, and moving the pump shaft to the ending position;

a valve release engaging the diaphragm valving to open the diaphragm valving to release steam from the first portion into the second portion of the diaphragm chamber thereby equalizing pressure on both sides of the diaphragm and allowing the spring to urge the piston and pump shaft back to its starting position; and a switch that selectively provides electrical power to the heater coil when the pump shaft is moving from its starting position toward its ending position.

2. The pump as described in claim 1 further comprising pump cylinder valving in the pump cylinder to allow water to move only in the predetermined direction in the pump cylinder.

3. The pump as described in claim 1 further comprising a magnet attached to the pump shaft and wherein the switch is a mechanical switch that is toggled by the movement of the magnet attached to the pump shaft.

4. The pump as described in claim 1 further comprising a digital control circuit and wherein the switch is a digital switch controlled by the digital control circuit.

5. The pump as described in claim 1 further comprising a rubber bladder communicated with the diaphragm chamber to temporarily store water to be supplied to the heater coil for generation of steam and water to fill the lower portion of the diaphragm chamber as the pump shaft returns to its starting position.

6. The pump as described in claim 1 further comprising a water filter communicated with the pump cylinder.

7. The pump as described in claim 1 further comprising a water deionization device communicated with the pump cylinder.

8. The pump as described in claim 1 wherein the diaphragm valving comprises a reed valve.

* * * * *